United States Patent [19]

Underwood

[11] 4,128,215

[45] Dec. 5, 1978

[54] TEXTILE SPOOL

[75] Inventor: Robert H. Underwood, 19 Stacy St., Saco, Me. 04072

[73] Assignees: Robert H. Underwood, Saco, Me.; Richard P. Crowley, Wellesley Hills, Mass.

[21] Appl. No.: 786,985

[22] Filed: Apr. 13, 1977

Related U.S. Application Data

[63] Continuation-in-part of Ser. No. 697,423, Jun. 18, 1976, Pat. No. 4,078,741.

[51] Int. Cl.[2] ..... B65H 75/14; B65H 75/22

[52] U.S. Cl. ..... 242/118.61; 242/115

[58] Field of Search ..... 242/118.61, 118.7, 118.4, 242/115, 71.8, 118.6, 118.8, 118.62, 77, 77.3, 77.4

[56] References Cited

U.S. PATENT DOCUMENTS

| | | | |
|---|---|---|---|
| 512,698 | 1/1894 | Grimm | 242/118.61 |
| 1,287,857 | 12/1918 | Brandt | 242/118.62 |
| 2,622,825 | 12/1952 | Faris | 242/118.61 |
| 2,720,179 | 10/1955 | Strocco | 242/118.61 X |
| 3,415,458 | 12/1968 | Newell | 242/71.8 |
| 3,822,841 | 7/1974 | Campbell | 242/115 |
| 3,905,561 | 9/1975 | Kelch et al. | 242/118.61 |

FOREIGN PATENT DOCUMENTS

| | | | |
|---|---|---|---|
| 15362 of | 1903 | United Kingdom | 242/118.61 |

*Primary Examiner*—George F. Mautz
*Attorney, Agent, or Firm*—Richard P. Crowley

[57] ABSTRACT

An improved textile spool having a removable plug element inserted at the one or both ends of the hollow tube of the spool, the plug element having a tongue element therein extending axially and inwardly when the plug is engaged within the end of the spool, the tongue element having a raised projection on its outward external surface, and the hollow tube having a circular passageway therein, whereby, in the assembled condition, the projection fits in an interlocking relationship within the passageway, and whereby the plug element may be easily removed by an axial outward force when the tongue element is moved out of an interlocking relationship.

8 Claims, 4 Drawing Figures

TEXTILE SPOOL

REFERENCE TO PRIOR APPLICATION

This application is a continuation-in-part of application Ser. No. 697,423, filed June 18, 1976,now U.S. Pat No. 4,078,741 .

BACKGROUND OF THE INVENTION

Textile spools for the carrying of wound filament material comprise a hollow tube with large-diameter end flanges secured to each end thereof, and are known as jack spools. Such jack spools include a pair of shafts which extend from each end of the tube, and which shafts are adapted to be placed in means to provide for the winding or unwinding of filament material onto or from the hollow tube. The hollow tube commonly comprises a reinforced cardboard tube, and may also be an aluminum tube or plastic tube. After winding of a filament material onto the hollow tube, the jack spool, with the material therein, is removed and unwound. However, after a portion of the filament material has been unwound, the residue is often found to be tangled, and the present practicre is to employ a sharp cutting knife to cut or to remove otherwise the residual or tangled filament material from the hollow tube, so that the hollow tube may be reused in the winding/rewinding process. After a period of use, the hollow tube, due to the damage inflicted by the cutting knife, must be discarded. Further, the employment of a cutting knife for the removal of the residual filament material constitutes a safety hazard to the user.

It is also desirable to have a means of quickly and effectively removing one or both flange elements from the hollow tubes; that is, to place the spool in a disassembled condition, so that the residual filament may be easily removed and the hollow tubes with the filament material may be kept or be easily removed for reuse, and to assemble quickly the textile spool; that is, to place the spool in an assembled condition ready for use. One improved textile spool which is easily and quickly assembled and disassembled is disclosed in my copending patent application U.S. Ser. No. 697,423, filed June 18, 1976, hereby incorporated by reference.

Another method of stripping textile fibers from a textile spool is described in U.S. Pat. No. 2,686,953 to A. J. Pike, wherein a removable head or plug assembly is employed at one end of a spool. The removable head is secured in an assembled condition by positioning a tension-biased ball in an annular depression in the hollow tube. The method and assembly described are not wholly satisfactory, since they do not permit the removable head end of the spool to be shaft-driven.

SUMMARY OF THE INVENTION

My invention relates to an improved textile spool, and in particular to an improved jack spool which may be easily assembled and disassembled for the removal and replacement of the hollow tube adapted to carry a filament material, and to the process of assembling and disassembling such improved spool. More particularly, my invention concerns an improved textile spool having a simple, easily and inexpensively manufactured, removable plug element at one or both ends of the spool.

My improved textile spool employs a removable plug element at one end, and preferably both ends, of the hollow tube of a spool, with the plug elements slidably and snugly engaged within the end of the tube. In one preferred embodiment, the tube walls have one and preferably two or a plurality of passageways; for example, small circular passageways, therein adapted to receive and seat a raised projection in the passageway to place the spool in an assembled condition. The plug element, which is positioned at the end of the tube with the passageways, has one or preferably more surface-raised projections therein which, in the normal biased position, extend outwardly generally perpendicularly from the tube axis, and protrude slightly beyond the external surface diameter of the plug element.

In the assembled position, wherein the removable plug element is snugly disposed within the one end of the hollow tube, the tension-biased projections on the surface of the plug are biased outwardly into an interlocking relationship with each of the discrete passageways in the tube. The plug elements are merely fully inserted in the one end of the tube and then rotated until the interlocking relationship occurs. In this assembled condition, the shaft, extending from that end of the plug element, may be driven to wind or unwind filamentary material on the tube. Typically, the projections extend into the passageway means slightly less than the tube wall diameter, so as not to project about the external surface of the tube and interfere with the winding of the filament roll.

My improved textile spool is easily and quickly placed in the disassembled condition simply by exerting an outward axial force, such as by pulling by hand the plug element or its shaft outwardly, to displace the biased projections inwardly from the passageways, so that the plug element may be slid from the open end of the tube. Disassembly may be aided by use of the fingers or otherwise to depress the projections in the passageways, while exerting axial force or by providing optionally for one or more finger holes or grasping means in the end of the plug assembly; for example, in the flange, as in, for example, U.S. Pat. No. 3,971,526. The ease of placing the textile spool in an assembled and disassembled condition and the ability to drive the shaft from the removable plug provide for an improved textile spool.

My plug element may be easily and inexpensively manufactured, in whole or in part, for example, by injection-molding, and may be composed of a hard, light-weight plastic material. The plug element comprises a cylindrical body with an external surface, the body adapted to fit snugly within one end of the tube, and the plug element having an axial shaft extending from one face thereof to drive or support the spool, the shaft being of plastic or other material, the other face of the plug element having axially extended therefrom one or more, and preferably two or more, elongated tongue elements, with the external surface coextensive with the external surface of the body. The tongue elements contain, on the outer external face surface, a raised projection, preferably a spheroidal-like projection, adapted to fit snugly in an interlocking relationship with the positioned passageway in the hollow tube in which the plug element is inserted. The position of the projections on the plug is arranged to become interlocked with the tube passageway on the correct and full insertion of the plug. The size and shape of the projections, as of the passageway, may vary as desired, and one or more projection may be placed on each tongue or extension.

The tongue extension from the body is semirigid, with the external surface about the diameter of the inner diameter of the tube. The extension is designed to yield generally perpendicularly to the axis and inwardly slightly at the extended end to permit the end to be biased inwardly and inserted in the open end of the tube, and also to provide a slight tension or spring-bias outwardly to retain the raised projections firmly locked in the interlocking position within the passageway, but also to be depressed inwardly easily on the application of axial force when the plug element is removed. The projections typically should be placed near the extended outward end of the tongue extension surface to provide good biasing action and flexibility of movement. My plug element may be composed of metal or more typically of a hard flexible plastic, and may be molded as an integral one-piece assembly, such as of acrylate resin, polycarbonate resin, nylon resin, and olefinic resin like polypropylene resin, or other materials.

In a less economically and structurally preferred, but satisfactory, embodiment, the raised projections, rather than being on the tongue element and the positioned passageways in the tube, may be placed on the inner surface of the tube. In this arrangement, the tube is manufactured to have on its inner surface one or more inwardly positioned, raised projections, with one or more positioned discrete passageways in the tongue element to arrange a similar, but reversed, interlocking relationship. This embodiment requires modification to the present tube in use, which is difficult to achieve without the use of newly manufactured tubes, while the preferred embodiment permits the user to adopt easily existing tubes for use with the plug assembly sold alone by merely drilling one or more holes in the existing tube.

My invention will be described and illustrated in its preferred embodiment; however, it is recognized that those persons skilled in the art may make certain changes and modifications in such illustrated embodiment, all of which are within the spirit and scope of my invention.

DESCRIPTION OF THE EMBODIMENTS

Figure 1:
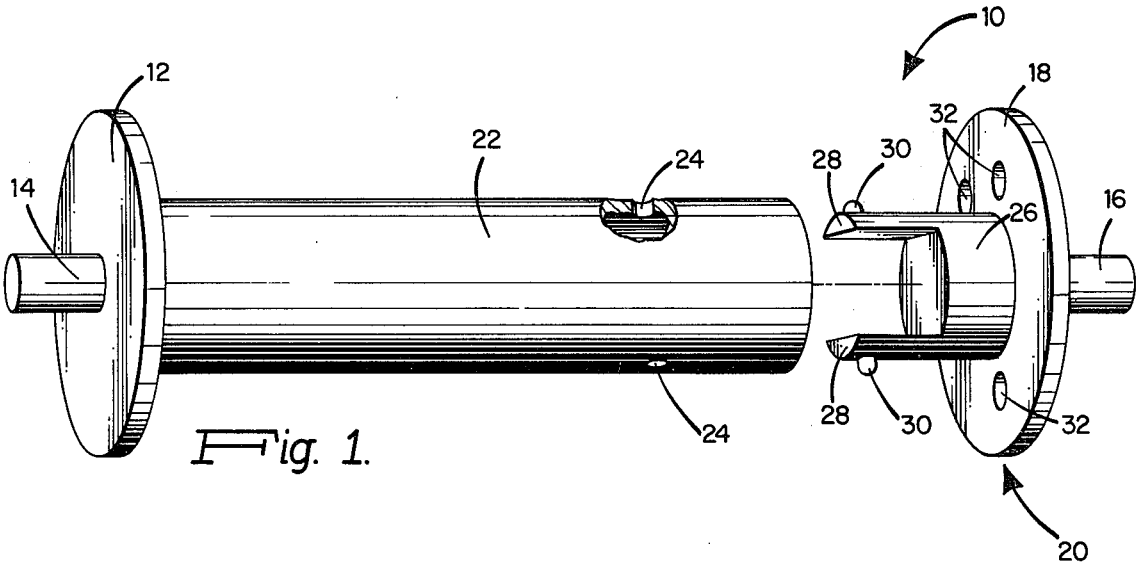
FIG. 1 is a partial perspective and exploded view of a textile spool in the disassembled condition.
Figure 2:
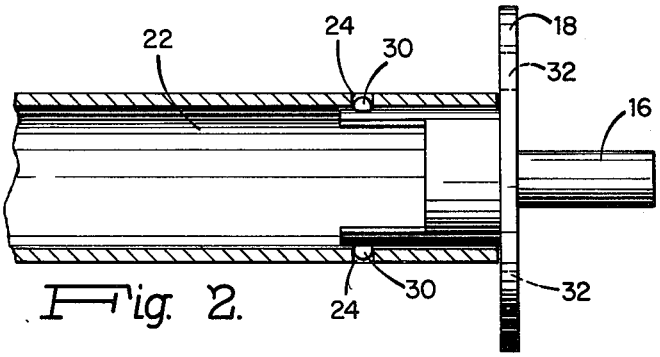
FIG. 2 is a partial cross-sectional view of my textile spool in the assembled condition.
Figure 3:
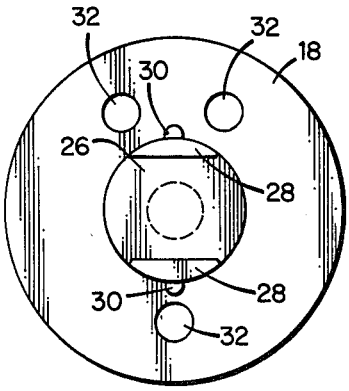
FIG. 3 is a plan end view of my plug assembly.

A textile spool 10 is shown in FIG. 1–3 comprising at the one end an axial shaft 14 and a flange 12 secured by a plug element or other means (not shown) to one end of a hollow tube 22. At the other end, the tube contains two small circular passageways 24 180° apart in the wall of the tube. The plug element 20, composed of a molded plastic material, includes an axial shaft 16, a flange 18 and a solid cylindrical body element 26 adapted to fit silidably and snugly within the diameter of the open end of the tube 22. Two opposing tongue elements 28 180° apart extend from the body element 26, with a semi-curved external surface coextensive with that external surface of the body element, each tongue element 28 containing, on the outward external surface, a raised semispherical projection 30 adapted to fit snugly in an interlocking relationship within the circular diameter of the passageways 24, the height of the projections 30 and the wall thickness of the tube 22 such that the upper part of the projections is about flush with the outer surface of the tube 22. Holes 32 are provided in the flange 18 to permit the insertion of the user's fingers to aid in assembly and disassembly of the textile spool.

In the unassembled condition shown in particular in FIG. 1, the plug assembly has been removed by an axial outward force which depresses the tongue elements 28 and removes the rounded projections 30 from the interlocking position in passageways 24 by the inward movement of the element 28. In the assembled condition shown in particular in FIG. 2, the projections 30 are locked in position in passageways 24, which permits the shaft 16 to be rotated without slippage of the plug assembly 20 in the one end of the tube. The plug assembly 20 may be used at one or both ends of the tube 22.

Figure 4:
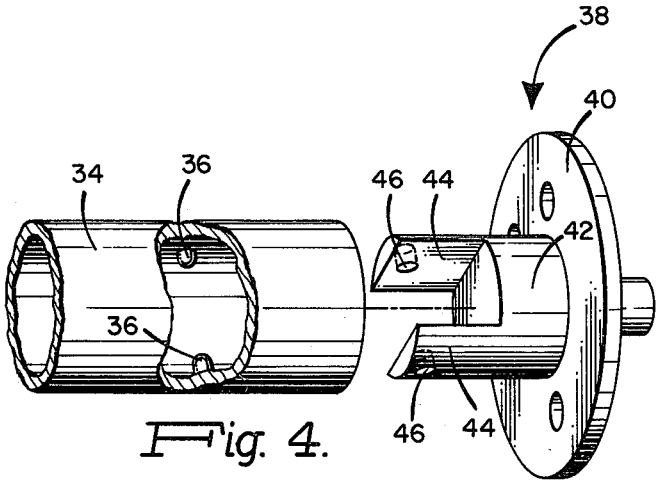
FIG. 4 is a partial cross-sectional exploded illustrative view of another embodiment.

FIG. 4 shows a hollow tube 34 with inwardly positioned, raised, rounded projections 36 on the internal wall surface of the tube 34. The plug assembly 38 comprises a flange 40, a plug body 42, two tongue extensions 44, each extension with a passageway 46 therein adapted to secure the projections 36 in an interlocking relationship in an assembled condition. Axial force outwardly permits the inward movement of the tongue elements 44 and the disengagement of the projections 36 to permit the plug body 42 to be removed and placed in the disassembled condition.

My invention permits the rapid adoption of existing hollow tubes to be used in my invention by merely drilling the necessary holes in the tube and then inserting and/or removing the plug assembly. My textile spool provides for many advantages over prior-art spools.

What I claim is:

1. An improved textile spool which comprises in combination:

(a) a hollow tube having a one end and another end, the tube adapted to carry a filament material thereon;

(b) a first flange at the one end and a second flange at the other end of the tube;

(c) a first axial shaft extending from the one end of the tube and a second axial shaft extending from the other end of the tube;

(d) at least one removable plug element which comprises (i) a cylindrical body element having an inner and an outer face and the body adapted to fit in a snug slidable relationship within the inner diameter at the one end of the tube, the first shaft extending centrally and outwardly from the outer face of the body element, and (ii) at least two elongated tongue elements extending generally axially from the inner face of the body element and the tongue elements generally in opposing positions, the tongue elements adapted to yield axially inwardly slightly on the application of a force and tension-biased to return to their original position;

(e) discrete raised projection means positioned on the surface toward the extending yieldable end of each of the tongue elements or on the internal wall of the tube;

(f) one or more discrete projection-receiving passageway means in the tongue elements or in the wall of the tube; and (g) the projection means and projection-receiving passageway so formed to permit insertion into and removal from the projection-receiving passageway by the respective use of an inward or outward axial force, whereby, in the assembled condition when the body element has been slid into a snug relationship within one end of the hollow tube, the respective discrete projections are engaged in an interlocking relationship within the respective opposite passageway means so that the axial shaft of the plug element may be driven by spool-driving means, and, on the application of an outward axial force, the tension-biased tongue elements yield inwardly to permit the axial removal of the plug element and to place the textile spool in the disassembled condition.

2. The spool of claim 1 wherein the flange at the one end has a plurality of finger-grip passageways therein to permit the user to apply an axial force to the removable plug element to place the spool in the disassembled or assembled condition.

3. The spool of claim 1 wherein the first flange, and removable plug element comprise an integral molded polymeric plug element.

4. The spool of claim 1 wherein the tube has a removable plug element at both the one end and at the other end of the tube.

5. The spool of claim 1 wherein the passageway means are small, generally circular holes, and the projection means are small, raised, rounded projections whose diameter permits the projections to fit snugly with the passageway means.

6. The spool of claim 1 wherein the passageway means comprise two circular holes located 180° degrees apart in the wall of the tube, and the projection means comprise a raised projection on the inwardly extended end of the external face surface of each of the two tongue elements.

7. The spool of claim 1 wherein the extended outward surface of the elongated tongue element is a rounded surface coextensive with the external surface of the body element, whereby the discrete projections are engaged in an interlocking relationship within the respective passageway means, and the outer surface of the tongue element fits in a slidable snug relationship with the internal surface of the hollow tube.

8. An improved textile spool which comprises in combination:

(a) a hollow tube adapted to carry a filament material wound or to be wound thereon;

(b) a removable plug assembly at each end of the tube, each assembly comprising an integral, molded, polymeric element which comprises (i) a flange element, (ii) a shaft extending outwardly from the flange element, (iii) a plug element which comprises a cylindrical body element adapted to fit in a slidable snug relationship within each end of the hollow tube, the flange element secured to the body element, (iv) a pair of opposing tongue elements, each extending generally axially inwardly from the inner face of the body element, with an external surface generally coextensive with at least a portion of the external surface of the body element, the tongue elements adapted to yield slightly inwardly on the application of a slight force, and (v) a pair of rounded raised projections, one each on the external surface of each tongue element and at the extended yieldable end thereof; and (c) a pair of discrete, circular, positioned passageways about 180° apart in the wall at each end of the hollow tube, whereby, in the assembled condition with the removable plug assembly within each end of the hollow tube, the raised projections are in an interlocking relationship with the passageways, and on the application of an axial force, the tongue elements yield inwardly to place the spool in a disassembled condition by the removal of one or both of the plug assemblies.

* * * * *